United States Patent [19]

Malec

[11] 4,208,190

[45] Jun. 17, 1980

[54] DIESEL FUELS HAVING ANTI-WEAR PROPERTIES

[75] Inventor: Robert E. Malec, Birmingham, Mich.

[73] Assignee: Ethyl Corporation, Richmond, Va.

[21] Appl. No.: 10,524

[22] Filed: Feb. 9, 1979

[51] Int. Cl.[2] ..... C10L 1/18; C10L 1/22

[52] U.S. Cl. ..... 44/53; 44/57; 44/72; 44/77

[58] Field of Search ..... 44/53, 57, 72, 77

[56] References Cited

U.S. PATENT DOCUMENTS

| | | | |
|---|---|---|---|
| 1,787,789 | 1/1931 | Lovell et al. | 44/72 |
| 2,706,677 | 4/1955 | Duncan et al. | 44/63 |
| 3,011,879 | 12/1961 | Buckmann | 44/58 |
| 3,399,982 | 9/1968 | Kautsky | 44/72 |
| 4,002,437 | 1/1977 | Broechx et al. | 44/66 |

FOREIGN PATENT DOCUMENTS

| | | | |
|---|---|---|---|
| 2701588 | 7/1978 | Fed. Rep. of Germany | 44/53 |

OTHER PUBLICATIONS

English Translation of Brazilian Patent Application No. P17700392.

*Primary Examiner*—Winston A. Douglas
*Assistant Examiner*—J. V. Howard
*Attorney, Agent, or Firm*—Donald L. Johnson; Robert A. Linn; Willard G. Montgomery

[57] ABSTRACT

An anti-wear compression ignition fuel for use in diesel engines comprising (1) a monohydroxy alkanol having from 1 to 5 carbon atoms, and (2) a wear inhibiting amount of a straight chain aliphatic primary amine, e.g. oleyl amine. Optionally, said fuel composition may also contain an ignition accelerator such as an organic nitrate.

It has recently been disclosed in Brazilian Patent Application No. P17700392 that alcohols, such as methanol and ethanol, can be substituted for conventional petroleum derived diesel fuels for burning in diesel engines, when used in combination with an ignition accelerator, such as ethyl nitrate or nitrite. Reportedly, the addition of alkyl nitrate or nitrite accelerators to the alcohol achieves a level of auto-ignition sufficient to operate in diesel engines. Unfortunately, these fuel compositions, devoid of any petroleum derived products, are notably deficient in lubricity or lubricating properties with the result that engine wear from the use of these fuels in internal combustion reciprocating diesel engines is a serious problem. Of particular concern are wear problems associated with the fuel injector mechanisms used in such engines. Wear problems have also been encountered in diesel engines operating on light diesel fuel oils are disclosed in U.S. Pat. No. 4,002,437.

12 Claims, No Drawings

DIESEL FUELS HAVING ANTI-WEAR PROPERTIES

The present invention relates to the use of certain straight chain aliphatic primary amines to reduce the wear properties of diesel fuel compositions of the alcohol or alcohol containing type. U.S. Pat. No. 3,011,879 discloses gasoline containing long chain aliphatic amines as carburetor detergents.

SUMMARY OF THE INVENTION

It has now been found that the addition of certain straight chain aliphatic primary amines to fuels adapted for use in diesel engines comprising a monohydroxy alkanol having from 1 to 5 carbon atoms and optionally containing an ignition accelerator, such as an organic nitrate, can significantly improve the wear characteristics of said fuels.

DESCRIPTION OF THE PREFERRED EMBODIMENTS

A preferred embodiment of the present invention is an anti-wear compression ignition fuel for use in diesel engines comprising (1) a monohydroxy alkanol having from 1 to 5 carbon atoms, and (2) a wear inhibiting amount of a straight chain aliphatic primary amine having the formula $$RNH_2$$

wherein R is an alkyl or alkenyl radical having 8 to 50 carbon atoms.

Another embodiment of the present invention is an anti-wear compression ignition fuel for use in diesel engines comprising (1) a monohydroxy alcohol having from 1 to 5 carbon atoms, (2) an ignition accelerator, and (3) a wear inhibiting amount of a straight chain aliphatic primary amine having the formula $$RNH_2$$

wherein R is an alkyl or alkenyl radical having 8 to 50 carbon atoms.

Monohydroxy alcohols which can be used in the present invention include those containing from 1 to 5 carbon atoms. Preferred alcohols are saturated aliphatic monohydric alcohols having from 1 to 5 carbon atoms. Methanol, ethanol, propanol, n-butanol, isobutanol, amyl alcohol and isoamyl alcohol are preferred alcohols for use in the present invention. Of these, ethanol is the most preferred.

The long chain primary amines which are suitable for use are those having the formula $RNH_2$, in which R is an alkyl or alkenyl radical having 8 to 50 carbon atoms. The amine to be employed may be a single amine or may consist of mixtures of such amines. Examples of long chain primary amines which can be used in the present invention are 2-ethylhexyl amine, n-octyl amine, n-decyl amine, dodecyl amine, oleyl amine, linolylamine, stearyl amine, eicosyl amine, triacontyl amine, pentacontyl amine and the like. A particularly effective amine is oleyl amine obtainable from Armak Chemicals Division of Akzona, Inc. under the name Armeen O or Armeen OD. Other suitable amines which are generally mixtures of aliphatic amines include Armeen T and Armeen TD, the distilled form of Armeen T which contains a mixture of 0–2% of tetradecyl amine, 24% to 30% of hexadecyl amine, 25% to 28% of octadecyl amine and 45% to 46% of octadecenyl amine. These Armeens (T and TD) are derived from tallow fatty acids. Lauryl amine is also suitable as is Armeen 12 or the distilled form Armeen 12D obtainable from the supplier indicated above. This product is about 0–2% of decylamine, 90% to 95% dodecylamine, 0–3% of tetradecylamine and 0–1% of octadecenylamine. Amines of the types indicated to be useful are well known in the art and may be prepared from fatty acids by converting the acid or mixture of acids to its ammonium soap, converting the soap to the corresponding amide by means of heat, further converting the amide to the corresponding nitrile and hydrogenating the nitrile to produce the amine. In addition to the various amines described, the mixture of amines derived from soya fatty acids also falls within the class of amines above described and is suitable for use according to this invention. It will be noted that all of the amines disclosed above as being useful are straight chain, aliphatic primary amines.

Lower molecular weight amines such as those containing less than 8 carbon atoms per molecule are found not to have the desired wear protection. Those amines having 16 to 18 carbon atoms per molecule and being saturated or unsaturated are particularly preferred.

Optionally, the fuel compositions of the present invention may contain an ignition accelerator. The ignition accelerator component of the anti-wear compression ignition fuel composition of the present invention is preferably an organic nitrate. Preferred organic nitrates are substituted or unsubstituted alkyl or cycloalkyl nitrates having up to about 10 carbon atoms, preferably from 2 to 10 carbon atoms. The alkyl group may be either linear or branched. Specific examples of nitrate compounds suitable for use in the present invention include, but are not limited to the following:

methyl nitrate
ethyl nitrate
n-propyl nitrate
isopropyl nitrate
allyl nitrate
n-butyl nitrate
isobutyl nitrate
sec-butyl nitrate
tert-butyl nitrate
n-amyl nitrate
isoamyl nitrate
2-amyl nitrate
3-amyl nitrate
tert-amyl nitrate
n-hexyl nitrate
2-ethylhexyl nitrate
n-heptyl nitrate
sec-heptyl nitrate
n-octyl nitrate
sec-octyl nitrate
n-nonyl nitrate
n-decyl nitrate
n-dodecyl nitrate
cyclopentylnitrate
cyclohexylnitrate
methylcyclohexyl nitrate
isopropylcyclohexyl nitrate and the esters of alkoxy substituted aliphatic alcohols, such as 1-methoxypropyl-2-nitrate, 1-ethoxpropyl-2 nitrate, 1-isopropoxy-butyl nitrate, 1-ethoxylbutyl nitrate and the like. Preferred alkyl nitrates are ethyl nitrate, propyl nitrate, amyl nitrates and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates would be n-hexyl nitrate, 2-ethylhexyl nitrate, 4-methyl-n-pentyl nitrate and the like. Preparation of the nitrate esters may be accomplished by any of the commonly used methods: such as, for example, esterification of the appropriate alcohol, or reaction of a suitable alkyl halide with silver nitrate.

Other conventional ignition accelerators may also be used in the present invention, such as hydrogen peroxide, benzoyl peroxide, etc. Further certain inorganic and organic chlorides and bromides, such as, for example, aluminum chloride, ethyl chloride or bromide may find use in the present invention as primers when used in combination with the alkyl nitrate accelerators of the present invention.

The amount of amine to be added to the compression ignition fuel compositions of the present invention should be enough to provide the desired wear protection. This concentration is conveniently expressed in terms of weight percent of amine based on the total weight of the compression ignition fuel composition. A preferred concentration is from about 0.01 to about 2.0 weight percent. A more preferred range is from about 0.1 to about 1.0 weight percent.

The amount of alkyl nitrate or nitrite ignition accelerator used should be an amount which will achieve a level of auto-ignition sufficient to allow the operation of diesel engines on the fuel composition of the present invention. A useful range is from about 0.1 weight percent to about 10 weight percent based on the total weight of the compression ignition fuel composition. Preferred amounts are between 0.5 weight percent to 5.0 weight percent.

Other additives may be used in formulating the compression ignition fuel compositions of the present inventions. These compounds include demulsifying agents, corrosion inhibitors, antioxidants, dyes, and the like, provided they do not adversely effect the anti-wear effectiveness of the amine.

Conventional blending equipment and techniques may be used in preparing the fuel composition of the present invention. In general, a homogeneous blend of the foregoing active components is achieved by merely blending the straight chain aliphatic primary amine component of the present invention with the monohydroxy alkanol and, if desired, ignition accelerator component of the present invention in a determined proportion sufficient to reduce the wear tendencies of the fuel. This is normally carried out at ambient temperature. The following examples illustrate the preparation of some typical fuel compositions of the present invention.

EXAMPLE I

To a blending vessel is added 1000 parts of 190 proof ethanol and 20 parts of a straight chain aliphatic primary amine. The mixture is stirred at room temperature until homogeneous forming a fuel composition useful for reducing and/or inhibiting the amount of engine wear in internal combustion reciprocating diesel engines operating on said fuel composition.

EXAMPLE II

To a blending vessel is added 1000 parts of 190 proof ethanol, and 5 parts of a straight chain aliphatic primary amine. The mixture is stirred at room temperature until homogeneous forming a fuel composition useful for reducing and/or inhibiting the amount of engine wear in internal combustion reciprocating diesel engines operating on said fuel composition.

The amounts of each ingredient in the foregoing compositions can be varied within the limits aforediscussed to provide the optimum degree of each property.

The lubricity or wear properties of the fuel compositions were determined in the 4-Ball Wear Test. This test is conducted in a device comprising four steel balls, three of which are in contact with each other in one plane in a fixed triangular position in a reservoir containing the test sample. The fourth ball is above and in contact with the other three. In conducting the test, the upper ball is rotated while it is pressed against the other three balls while pressure is applied by weight and lever arms. The diameter of the scar on the three lower balls are measured by means of a low power microscope, and the average diameter measured in two directions on each of the three lower balls is taken as a measure of the anti-wear characteristics of the fuel. A larger scar diameter means more wear. The balls were immersed in base fuel containing the test additives. Applied load was 5 kg and rotation was 1,800 rpm for 30 minutes at ambient temperature. Tests were conducted both with base fuel* alone and base fuel containing the test additives. Results are as follows:

*Base fuel was 190 proof ethanol.

| Additive[1] Conc. (wt. %) | Scar Diameter (mm) Run 1 | Run 2 |
|---|---|---|
| None | 0.89 | 0.90 |
| 1.0 | 0.50 | |

[1]Oleyl amine

In two separate tests, the test fuel without any additive gave scar diameters of 0.89 and 0.90 mm, respectively. The addition to the base fuel of oleyl amine at a concentration of 1.0 weight percent significantly reduced the wear index to 0.50 mm. Thus, the incorporation of a straight chain aliphatic primary amine into alcohol or alcohol containing fuels significantly increases the wear inhibiting properties of these fuels. The straight chain aliphatic primary amines of the present invention are also effective anti-wear agents when used in fuel compositions comprising mixtures of monohydroxy alkanols having from 1 to 5 carbon atoms and fuel oil boiling above the gasoline boiling range, i.e. a mixture of hydrocarbons boiling in the range of from about 300° F. to about 700° F. Such compositions may also contain ignition accelerators such as the organic nitrates referred to previously.

Further, the straight chain aliphatic primary amines of the present invention are also effective anti-wear agents when used in diesel fuel compositions comprising a mixture of hydrocarbons boiling in the range of from about 300° F. to about 700° F. devoid of any alcohol components. Such fuel oil compositions comprise both the heavy and light diesel fuel oils which are commonly used at present as fuels in diesel motor vehicles. Such fuel compositions may also contain ignition accelerators such as organic nitrates as well as other additives such as demulsifying agents, corrosion inhibitors, antioxidants, dyes, and the like commonly used in these types of fuel compositions.

Thus, another embodiment of the present invention is an anti-wear compression ignition fuel for use in diesel engines comprising a fuel oil boiling above the gasoline range containing a wear inhibiting amount of a straight chain aliphatic primary amine having the formula $RNH_2$ wherein R is an alkyl or alkenyl radical having from 8 to 50 carbon atoms.

I claim:

1. As a new composition of matter, an anti-wear compression ignition fuel for use in diesel engines comprising (1) a monohydroxy alkanol having from 1 to 5 carbon atoms, and (2) a wear inhibiting amount of a straight chain aliphatic primary amine having the formula $RNH_2$ wherein R is an alkyl or alkenyl radical having from 8 to 50 carbon atoms.

2. The composition of claim 1 wherein said monohydroxy alkanol is ethanol.

3. The composition of claim 2 wherein said amine is oleyl amine.

4. The composition of claim 3 containing from about 0.01 to about 2.0 weight percent oleyl amine based on the total weight of said composition.

5. As a new composition of matter, an anti-wear compression ignition fuel for use in diesel engines comprising (1) a monohydroxy alkanol having from 1 to 5 carbon atoms, (2) an ignition accelerator, and (3) a wear inhibiting amount of a straight chain aliphatic primary amine having the formula $RNH_2$ wherein R is an alkyl or alkenyl radical having from 8 to 50 carbon atoms.

6. The composition of claim 5 wherein said monohydroxy alkanol is ethanol.

7. The composition of claim 5 wherein said ignition accelerator is a substituted or unsubstituted alkyl or cycloalkyl nitrate having up to 10 carbon atoms.

8. The composition of claim 5 wherein said amine is oleyl amine.

9. The composition of claim 6 wherein said ignition accelerator is selected from methyl nitrate, ethyl nitrate, propyl nitrate, amyl nitrates, hexyl nitrates or a mixture of primary amyl nitrates and primary hexyl nitrates.

10. The composition of claim 9 wherein said ignition accelerator is ethyl nitrate.

11. The composition of claim 9 wherein said amine is oleyl amine.

12. The composition of claim 11 containing from about 0.1 to about 10.0 weight percent ignition accelerator and from about 0.01 to about 2.0 weight percent oleyl amine based on the total weight of said composition.

* * * * *